US010991497B2

(12) United States Patent
Stresau et al.

(10) Patent No.: US 10,991,497 B2
(45) Date of Patent: Apr. 27, 2021

(54) APPARATUS AND METHODS FOR CONTROLLING A CHARGED PARTICLE IN A MAGNETIC FIELD

(71) Applicant: ADAPTAS SOLUTIONS PTY LTD, Clyde (AU)

(72) Inventors: Richard Stresau, Middle Cove (AU); Kevin Hunter, Glenhaven (AU); Yair Benari, Hornsby (AU); Russell Jurek, Summer Hill (AU); Toby Shanley, Granville (AU)

(73) Assignee: ADAPTAS SOLUTIONS PTY LTD, Clyde (AU)

( * ) Notice: Subject to any disclaimer, the term of this patent is extended or adjusted under 35 U.S.C. 154(b) by 191 days.

(21) Appl. No.: 16/075,269

(22) PCT Filed: Feb. 2, 2017

(86) PCT No.: PCT/AU2017/050087

§ 371 (c)(1),
(2) Date: Aug. 3, 2018

(87) PCT Pub. No.: WO2017/132731

PCT Pub. Date: Aug. 10, 2017

(65) Prior Publication Data

US 2019/0088393 A1 Mar. 21, 2019

Related U.S. Application Data

(60) Provisional application No. 62/290,609, filed on Feb. 3, 2016.

(51) Int. Cl.
*H01F 7/02* (2006.01)
*H01J 43/04* (2006.01)

(52) U.S. Cl.
CPC ..... *H01F 7/0278* (2013.01); *H01J 43/04* (2013.01)

(58) Field of Classification Search
CPC ..... H01F 7/0278; H01J 43/04
See application file for complete search history.

(56) References Cited

U.S. PATENT DOCUMENTS 2,175,697 A * 10/1939 Nelson ..... H01J 43/04 315/12.1
2,786,971 A * 3/1957 Tyrell ..... H01F 7/0278 335/302

(Continued)

FOREIGN PATENT DOCUMENTS

JP H08273897 A 10/1996

OTHER PUBLICATIONS

International Search Report dated May 15, 2017 for corresponding International Patent Application PCT/AU2017/050087 dated Feb. 2, 2017.

(Continued)

*Primary Examiner* — Mohamad A Musleh
(74) *Attorney, Agent, or Firm* — David D. Brush; Westman, Champlin & Koehler, P.A.

(57) ABSTRACT

An apparatus for providing a magnetic field includes a magnet having a surface, and a structure disposed above the magnet surface. The structure includes a material of high magnetic permeability. The apparatus provides an interface between the material of high magnetic permeability and a material of low magnetic permeability. The apparatus may have two poles in magnetic communication with the magnet, the poles extending above the surface of the magnet, and the structure is disposed between the poles. The structure may have alternating regions of high magnetic permeability and low magnetic permeability. The apparatus alters the magnetic field of the magnet to reduce or remove a disorder in (Continued)

the magnetic field, and/or decrease the magnitude of the magnetic field, and/or induce a distortion in the magnetic field, and/or align or re-align the magnetic field, and/or orientate or re-orientate the magnetic field, and/or alter distribution or shape of the magnetic field.

18 Claims, 13 Drawing Sheets

(56) References Cited

U.S. PATENT DOCUMENTS

| | | | | |
|---|---|---|---|---|
| 2,797,360 | A * | 6/1957 | Eaglesfield | H01J 23/00 315/39.3 |
| 3,227,931 | A * | 1/1966 | Adler | H01J 23/087 335/304 |
| 3,253,194 | A * | 5/1966 | Parker | H01F 7/0278 335/302 |
| 3,325,758 | A * | 6/1967 | Cook | H01J 23/10 335/217 |
| 3,673,494 | A | 6/1972 | Vitek et al. | |
| 4,429,254 | A | 1/1984 | Chang | |
| 6,982,428 | B2 | 1/2006 | Stresau et al. | |

OTHER PUBLICATIONS

Written Opinion of the International Searching Authority dated May 15, 2017, for corresponding International Patent Application PCT/AU2017/050087 dated Feb. 2, 2017.

* cited by examiner

APPARATUS AND METHODS FOR CONTROLLING A CHARGED PARTICLE IN A MAGNETIC FIELD

The present application is a Section 371 National Stage Application of International Application No. PCT/AU2017/050087, filed Feb. 2, 2017, which is incorporated by reference in its entirety and published as WO 2017/132731 A1 on Aug. 10, 2017, in English.

FIELD OF THE INVENTION

The present invention relates to generally to components of scientific analytical equipment. More particularly the invention relates to apparatus and methods for improving the control of moving particles in a magnetic field, for example in electron multipliers.

BACKGROUND TO THE INVENTION

The ability to control the motion of charged particles is central to the operation of many scientific instruments. Typically, separate electric and magnetic fields are used to deflect the path of moving particles toward a target. Taking electrons as an example, these particles are negatively charged and have a magnetic dipole moment, and accordingly can be exposed to electric and magnetic fields with the aim of influencing the path of travel. Generally, the strength and orientation of the electric and magnetic fields are set so as to precisely deflect an electron in motion toward a target surface.

Electron multipliers are but one example of the use of electric and magnetic fields to control the motion of an electron. These components are configured to amplify the secondary electron signal caused by the impact of a charged particle onto a surface, such as the impact of an ionized species on a detector in a mass spectrometer. The impact of each charged particle causes the emission of (typically) two or more secondary electrons from a dynode of the detector. These secondary electrons are directed toward a second dynode, and upon impact release further secondary electrons. By the use of a series of dynodes in this way, the electron signal is geometrically amplified such that impact of a fundamental unit of incident electronic charge ($1.602\times10^{-19}$ Coulombs) can produce an electrical current that is sufficient for measurement with conventional electronics at the final target electrode.

The temporal, spatial and energetic distribution of free electrons upon striking the target surface is partially determined by variations in both the applied electric and magnetic field strength and direction.

The conductive materials used to provide the electrical field are normally sufficiently homogenous so as to provide highly uniform electric fields. However, ferromagnetic materials conventionally used to provide the magnetic field contain local inhomogeneities (and especially inhomogeneities in the magnet surface) that lead to relatively large variations in the magnetic field. These variations are significant to the extent that some loss of electrons is virtually inevitable, leading to signal loss.

The ability to precisely control the spatial, temporal and energetic distribution of an electron pulse is therefore currently limited by the natural, local variation in magnetic field arising from the variation in magnetic permeability of crystalline grains that compose the ferromagnetic material.

Quite apart from the local variations in magnetic field caused by in homogeneities, a further problem with conventionally used magnets is a slight (but practically significant) misalignment of the N-S field direction with the geometry of the magnet. For example, in a rectangular prismatic-shaped magnet the field direction can deviate several of degrees from the physical axis of the magnet. This deviation can lead to a loss of electrons. Accordingly, it is desirable in some circumstances to alter the magnetic field in a magnet so as to align with the physical axis of the magnet, this in turn resulting in better control of electrons.

The ability to alter a magnetic field may also be exploited to straighten (or at least partially straighten) a curved field line so as to more effectively control movement of an electron. Conversely, where a portion of a field line is essentially linear (such as in the central region between two poles) it may be desired to curve the field line. Alternatively it may be desired for field lines to be \ compressed closely together for the purpose of improving electron control.

There is a clear need in the art for improved, or at least alternative means for providing magnetic fields in scientific instrumentation. It is an aspect of the present invention to provide improved apparatus and methods, or to at least provide an alternative to prior art means.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides an apparatus for providing a magnetic field, the apparatus comprising:

a magnet having a surface, and a structure disposed above the magnet surface, the structure composed at least in part from a material of high magnetic permeability.

wherein the apparatus is configured so as to provide an interface between the material of high magnetic permeability and a material of low magnetic permeability.

In one embodiment, the apparatus comprises two poles in magnetic communication with the magnet, the poles extending above the surface of the magnet, and wherein the structure is disposed between the poles.

In one embodiment of the apparatus, the material of low magnetic permeability is a gas or vacuum surrounding the structure.

In one embodiment of the apparatus, the structure is composed of a material of high magnetic permeability and a material of low magnetic permeability arranged into discrete regions, the regions being interfacing.

In one embodiment of the apparatus, the structure has alternating regions of high magnetic permeability and low magnetic permeability.

In one embodiment of the apparatus, each region is substantially elongate.

In one embodiment of the apparatus, each region is shaped so as to be substantially symmetrical with reference to its central longitudinal axis.

In one embodiment of the apparatus, the region(s) having a low magnetic permeability is/are provided by one or more discontinuities in the structure, and/or one or more apertures in the structure.

In one embodiment of the apparatus, the region(s) of low magnetic permeability is/are aligned generally along the lines of equal scalar magnetic flux density formed by the magnet.

In one embodiment of the apparatus, the region(s) of high magnetic permeability structure are provided by one or more bars.

In one embodiment of the apparatus, the structure comprises two or more bars, the bars joined by one or more joining regions.

In one embodiment of the apparatus, the structure comprises two or more bars, the bars are substantially parallel with each other, and/or substantially parallel with the magnet surface, and/or substantially parallel with the poles (where present).

In one embodiment of the apparatus, the bar(s) is/are aligned generally along the lines of equal scalar magnetic flux density formed by the magnet.

In one embodiment of the apparatus, the joining regions are aligned generally across the lines of equal scalar magnetic flux density formed by the magnet.

In one embodiment of the apparatus, the regions of high magnetic permeability provide a grid-like formation.

In one embodiment of the apparatus, the material of high magnetic permeability has a footprint which is at least 50% of the magnet surface, or the area between the poles (where present).

In one embodiment, the apparatus comprises a second structure disposed above the first structure, the second structure is as described herein.

In one embodiment of the apparatus, the first structure is substantially parallel to the second structure.

In one embodiment of the apparatus, the structure(s) have/has a composition, and/or dimensions, and/or geometry, and/or disposition so as to alter the magnetic field about the magnet.

In one embodiment of the apparatus, the structure(s) have/has a composition, and/or dimensions, and/or geometry, and/or disposition so as to alter the magnetic field about the magnet or between the poles (where present).

In one embodiment of the apparatus, the structure (or the lowest structure where two or more structures are present) is disposed at least about 0.1 mm above the magnet surface.

In one embodiment of the apparatus, the structure (or the lowest structure where two or more structures are present) is disposed at least about 1 mm above the magnet surface.

In one embodiment of the apparatus, the structure (or none of the structures where two or more structures are present) does/do not contact the poles.

In one embodiment of the apparatus, substantially all points on a lower surface of the structure (or the lowest structure where two or more structures are present) are a substantially equal distance from the magnet surface.

In one embodiment of the apparatus, the structure(s) is/are substantially planar.

In one embodiment of the apparatus, the magnet surface is substantially planar, and the structure(s) is/are substantially parallel to the magnet surface.

In one embodiment of the apparatus, the structure is configured to alter the magnetic field of the magnet to reduce or remove a disorder in the magnetic field, and/or decrease the magnitude of the magnetic field, and/or induce a distortion in the magnetic field, and/or align or re-align the magnetic field, and/or orientate or re-orientate the magnetic field, and/or alter the distribution or shape of the magnetic field.

In one embodiment of the apparatus, the magnet is configured to control the motion or energy of an electron.

In a second aspect, the present invention provides an electron multiplier comprising the apparatus as described herein.

In a third aspect, the present invention comprises a method for controlling a magnetic particle, the method comprising the steps of:

providing a magnetic particle, providing the apparatus as described herein, urging the magnetic particle toward the apparatus, and allowing the apparatus to control the magnetic particle.

In one embodiment of the method, the magnetic particle is an electron.

In a fourth aspect, the present invention comprises a method for amplifying an electron signal comprising the method for controlling a magnetic particle as described herein, wherein control of electron is used to urge an electron toward and/or away from a dynode.

DETAILED DESCRIPTION OF THE INVENTION INCLUDING PREFERRED EMBODIMENTS

Figure 1:
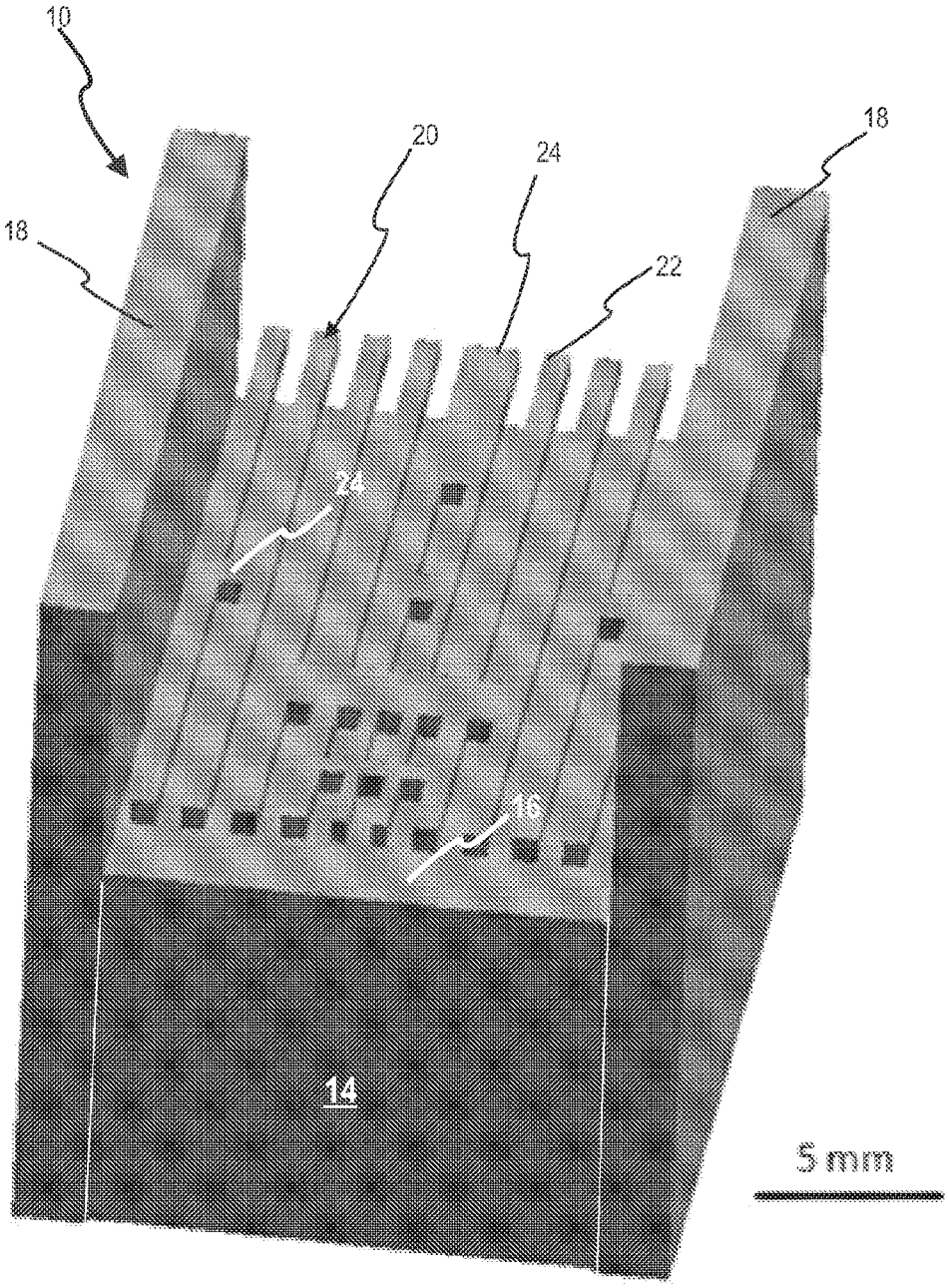
FIG. 1 is a perspective view of a magnetically permeable grid of the present invention as disposed within a magnet of an electron multiplier.

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

It is not represented that any embodiment of the invention has all advantages described herein, or indeed any advantage over the prior art. Some embodiments may simply provide a useful alternative to the prior art.

The present invention is predicated at least in part on Applicants finding that placement of a structure providing an interface between a material of high magnetic permeability and a material of low magnetic permeability in a magnetic field is capable of altering the field to achieve a desired end for. Accordingly, in a first aspect the present invention provides an apparatus for providing a magnetic field, the apparatus comprising: a magnet having a surface, and a structure disposed above the magnet surface, the structure composed at least in part from a material of high magnetic permeability, wherein the apparatus is configured so as to provide an interface between the material of high magnetic permeability and a material of low magnetic permeability.

In a basic form of the invention, the structure may be a simple plate composed of a magnetically permeable material. The air (or vacuum) surrounding the plate provides a material of low magnetic permeability. Thus, at an edge face of the plate an interface between materials of high and low magnetic permeability is formed. More complex embodiments having grid-like formations or composed of composite materials are discussed further infra.

The ability to smooth an inconsistency in a magnetic field may, in some embodiments, overcome or ameliorate the negative effect of an inhomogeneity in a magnet. Thus, the magnetic field is closer to a field that would be predicted theoretically or closer to a field that is measured empirically in relation to a magnet without an inhomogeneity. Improvement in the consistency of the magnetic field may be important for applications involving the deflection of atomic and subatomic particles whereby an inconsistency may lead to deflection of the particle along an unexpected path. Other advantages of the present apparatus with regard to field distortion and modulation are further discussed infra.

The magnet of the present apparatus may be any type of magnet suitable for the operational requirement in terms of composition, construction, field strength, or field geometry. As an example only, a permanent rare earth magnet may be used. Rare earth magnets based on neodymium are typically used in the control of electrons, an example being those having the formula $Nd_2Fe_{14}B$ having a polycrystalline structure. In some embodiments, the magnet includes separate or integral poles which extend above the surface of the magnet. The poles may form a channel with the poles forming opposing walls, and the magnet surface forming the floor), such that the magnetic field within the channel can control the motion of particles (such as electrons) entering the channel. Typically the control is a deflection of a moving electron. Each pole is typically plate or block in magnetic communication with the lateral side of the magnet, and extending upwardly at about 90 degrees.

The structure is composed (at least in part) of a magnetically permeable material, and preferably a highly magnetically permeable material. The skilled artisan is familiar with the concept of magnetic permeability in electromagnetism. A material is considered magnetically permeable if it is capable of supporting the formation of a magnetic field within itself. Expressed one way, permeability may be considered as the degree of magnetization that be induced in the material in response to an applied magnetic field. In the present invention, the magnetically permeable material is subject to a magnetic field applied by the magnet of the apparatus and upon application of the field becomes itself magnetized. As will become clear upon consideration of the experimental results disclosed herein, the magnetic field generated by the structure when combined with that of the magnet of the apparatus provides for a smoothed and/or distorted field overall.

As will be readily apparent to the skilled artisan, many types of materials will find utility as a magnetically permeable material in the context of the present apparatus. Paramagnetic materials of many types will typically find use. Ferromagnetic materials such as iron, and iron alloys such as cobalt iron, carbon steel, ferritic stainless steel, ferrite, mu-metal, permalloy, metglas and the like will be useful in many embodiments given that such materials do not readily demagnetize.

In some embodiments, the material having a high magnetic permeability has an absolute permeability of at least about $10^{-5}$, $10^{-4}$, $10^{-3}$, $10^{-2}$, or $10^{-1}\mu$ [H/m]. Typically, the material has a permeability of at least about $10^{-3}\mu$ [H/m].

Considered another way, the material having a high magnetic permeability may have a relative magnetic permeability of at least about $10^1$, $10^2$, $10^3$, $10^4$, $10^5$ or $10^6\mu/\mu_0$.

In selecting a suitable high magnetic permeability material (or indeed any other parameter of the structure such as the physical dimensions), consideration may be given to the magnitude of the magnetic flux of the magnet of the apparatus. In some circumstances for the structure be configured so as to not be saturated (including not being over-saturated) by the magnetic flux of the magnet of the apparatus. Where the structure is unable to conduct all the magnetic flux of the magnet, the ability of the structure to smooth inconsistencies in the field or to distort the field is reduced. Expressed another way, the structure may be configured so as to not be overloaded by the magnetic field of the apparatus magnet.

In other circumstances, it will be desirable to saturate or over-saturate the structure with magnetic flux. For example, saturation may be used to induce a desirable distortion in the magnetic field, or to control a flux gradient.

It will be readily appreciated from the foregoing that in the design of an apparatus of the present invention, consideration will typically be given to the magnet and structure as paired components given the functional interrelationship between the two. In some embodiments, the magnetic flux exceeds the ability of the structure to conduct the flux by at least about 1, 2, 3, 4, 5, 6, 7, 8, 9, 10, 15, 20, 25, 30, 35, 40, 45 or 50%.

In addition or as an alternative to the selection of material, saturation of the structure may be avoided by increasing a physical dimension of the structure, or caused by decreasing a physical dimension. In particular, increasing the thickness of the structure (at least in some parts) typically improves the ability to conduct magnetic flux.

It will be appreciated however, that embodiments whereby the structure is saturated or over-saturated with magnetic flux of the apparatus magnet will still be operable to the extent that some improvement in the consistency of the magnetic field or some distortion in the field nevertheless results.

In the selection of a material of high magnetic permeability, regard may be had to the magnetic permeance of the material. As is understood by the skilled person, permeance is a measure of the ability of a material to conduct magnetic flux. A saturated material will conduct magnetic flux but the amount it conducts is capped. Where it is desirable to cap the magnetic flux at a high field strength (H) a material of high permeability is preferred in some circumstances. Mu-metals have exceptionally high permeability at low magnetic field, but such metals still will not cap at the flux levels which may be required at high magnetic field for certain applications.

In applications directed to the control of electrons, high magnetic field strengths are often used. However, However, in applications using a low magnetic field strength a material having a high permeability at low field strength may be preferred (exemplary materials being mu-metals and like).

For reasons of generally technical suitability, availability and cost the material may be a carbon-steel. While this material does not have a particularly high permeability at low magnetic field strengths, it saturates at high filed strengths and therefore may be used to distribute large magnetic potentials across its length. Increasing thicknesses of carbon-steel have a higher capability of distributing the potentials more evenly. By combining permeability with cross-sectional area, it is possible to control the total magnetic flux.

Exemplary thickness for the structure fall between about 0.1 mm, and about 20 mm. For mild carbon steel, the thickness is typically between about 0.2 mm and about 10 mm.

The distance between the magnetic surface and the lower surface of the structure may be set by means of routine experimentation. In some embodiments the distance is negligible or zero. In other embodiments the distance is in the range of 0.1 mm to about 10 mm, and in other embodiments between about 0.1 mm to about 5 mm, and in yet other embodiments between about 0.1 mm to about 1 mm.

In many instances the lower surface of the structure is planar, as is the magnet surface, and in which case the distance is uniform. Where the one or both of the surfaces in not planar, the distance is taken to mean the shortest distance, or the average distance, or the median distance. Preferably, the shortest distance is intended.

Included within the ambit of the present application is an arrangement where neither the magnet surface nor the lower surface of the structure are planar. For example, either surface may be uneven, convoluted, undulating or curved. In such circumstances, the distance between any two points may be the same. For example, where the magnet surface is curved, the lower surface of the structure may be identically curved such that a space having a fixed height is present between the two surfaces.

In some embodiments, the structure is a plate, or is plate-like in geometry. The plate may not be continuous, and may have one or more discontinuities or apertures. A discontinuity or aperture may be disposed at the edge of the plate (such that the edge is irregular) and/or within the edge confines of the plate.

Where the plate has a plurality of discontinuities or apertures, they may be arranged in an orderly manner, and may be arranged in a regular pattern. For example, the discontinuities or apertures may be disposed is rows or in columns. Highly regular patterns such a grid patterns are also contemplated to be useful.

A discontinuity may be any shape, but is preferably a geometrical shape such as a square or a rectangle. Preferably the discontinuity or aperture is substantially elongate rectangular shape. Where the discontinuity or aperture is elongate, it is generally aligned with the lines of equal scalar magnetic flux density formed by the apparatus magnet.

The effect of the discontinuity or aperture is to provide a region of low magnetic permeability. Depending on the environment the discontinuity or aperture may be occupied with air or with vacuum, both of which have a relative magnetic permeability of about 1.0.

In other embodiments the region of low magnetic permeability is provided by the interposition of a material of relatively low magnetic permeability about the structure. Such material may be a plastic, a ceramic, or a metal with a low magnetic permeability. It is possible to use a material a relatively high magnetic permeability which is arranged to have a saturating level of magnetic flux passing through it to reduce its effective relative magnetic permeability. In consideration of that possibility, the term "low magnetic permeability" should be construed to include a material having a low effective magnetic permeability.

As an alternative to the plate embodiment, or as a modification to the plate embodiment, the structure may comprise one or more bars. Generally the bar(s) are aligned with the lines of equal scalar magnetic flux density formed by the apparatus magnet. The general alignment of features of the structure in relation to flux density lines assists in the magnetic potential redistribution, such that the magnetic field is the same or similar in orientation to that of the apparatus magnet.

The bars are typically thicker than a wire, and/or wider than a wire. In terms of thickness, the bar may be at least about 0.1, 1, 2, 3, 4 or 5 mm. In terms of width, the bar may be at least about 0.1, 1, 2, 3, 4, or 5 mm wide. In some embodiments, the width is greater than the thickness. In some embodiments the bar has a square or rectangular cross-section.

However configured, the structure is typically of rigid construction. Materials having the required resistance to deformation and provided at sufficient cross-sectional area may be chosen to achieve that end. Where a flexible construction is required ductile metals may be employed.

The bars may be joined by joining regions which are formed integrally with the bars, or in some embodiments formed separately to the bars. Irrespective of the means of construction, the bars and joining regions may be disposed at right angles to each other. In some embodiments, the bars and joining regions for a grid. The grid may be a perfect grid having equally spaced bars and equally spaced joining regions, however more typically there will be some irregularity. In any event, the grid may have a line of symmetry. Where the structure is elongate the line of symmetry is typically along the central longitudinal axis.

Typically, the structure does not contact the magnet or the magnet poles. In this arrangement (and where the structure is not supported by the magnet or poles) the apparatus may comprise structure support means (such as a bracket) configured to fixed the structure in a desired position. The structure support means may have low or negligible magnetic permeability and/or may have low or negligible electrical conductivity, with materials such as plastics or ceramics being generally useful in this regard.

Given that the structure is disposed above a magnet surface, the structure may be considered provide a footprint with respect to the surface of the magnet. A footprint of 100% will be found where the structure is continuous and has the same area as the magnet surface. The introduction of discontinuities or apertures or regions of low magnetically permeability into the structure will reduce the footprint to less than 100%. In some embodiments the footprint of the structure is between about 10% and about 90%, or between about 20% and about 80%, or between about 30% and about 70%, or between about 40% and about 60%.

While a substantially planar geometry will be typically useful, in some embodiments of the present apparatus, the structure is substantially U-shaped or V-shaped with lines of magnetic flux running longitudinally between the arms of the U-shape or V-shape.

In other embodiments of the present apparatus, the structure is formed into a looped structure having a geometrically regular cross-section. For example, the looped structure may be cylindrical or box-shaped and having either open ends of closed ends.

In some embodiments, the apparatus of the present invention comprises a second structure disposed above the first structure referred to above. The second structure may have any of the features described as for the first structure as described elsewhere herein. In some embodiments, the first and second structures are substantially identical and positioned such that any features (such as edges, discontinuities, apertures, bars, and joining regions) are substantially coincident.

It has been found that improved field smoothing or distorting effects may be obtained where two structures are used, and particularly in any space formed between the two structures.

The distance between the first and second structures may be defined by the lower surface of second structure and the upper surface of the first structure. The distance may be set by means of routine experimentation or by simulations means well known to the skilled artisan. In some embodiments the distance is negligible or zero. In other embodiments the distance is in the range of 0.1 mm to about 10 mm, and in other embodiments between about 0.1 mm to about 5 mm, and in yet other embodiments between about 0.1 mm to about 1 mm. Other embodiments require a greater distance such as between about 5 mm and 50 mm.

In many instances the lower surface of the second structure is planar, as is the upper surface of the first structure, and in which case the distance is uniform. Where the one or both of the surfaces in not planar, the distance is taken to mean the shortest distance, or the average distance, or the median distance. Preferably, the shortest distance is intended.

In some embodiments of the apparatus, the distance between the first and second structures is a multiple of the distance between the first structure and the magnet surface. Multiples such as 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9 and 3.0 are contemplated.

Typically, where the first and second structures are substantially planar, the two structures are substantially parallel.

Included within the ambit of the present application is an arrangement where neither the lower surface of the second structure nor the upper surface of the first structure are planar. For example, either surface may be uneven, convoluted, undulating or curved. In such circumstances, the distance between any two points may be the same. For example, where the upper surface of the first structure is curved, the lower surface of the second structure may be identically curved such that a space having a fixed height is present between the two surfaces.

The present apparatus may be configured for use in an electron multiplier, such contrivances being known to the skilled artisan. It is anticipated that an existing electron multiplier may be modified to comprise one or more structures described herein by simply disposing and one or more structures above the surface of an existing magnet in the electron multiplier. Where the structure(s) require support, the skilled artisan is amply enabled to provide appropriate means. Alternatively, the apparatus is formed de novo in the course of manufacturing and electron multiplier. It will be understood however that the present apparatus has broad applicability, and the present invention will find use in many contexts apart from electron multipliers.

In a further aspect, the present invention provides a method for controlling a magnetic particle, the method comprising the steps of: providing a magnetic particle, providing the apparatus as described herein, urging the magnetic particle toward the apparatus, and allowing the apparatus to control the magnetic particle. In one embodiment, the magnetic particle is an electron.

The step of providing the magnetic particle may be by the liberation of a free particle from a solid, liquid or a gas by the application of sufficient energy. Where the apparatus is used in the context of an electron multiplier, the particle is a secondary electron released from an emissive surface (such as a dynode) in response to the impact of a charged or uncharged particle (typically an ion or an electron).

The step of urging may involve the acceleration of the particle by electrical, magnetic, electromagnetic, kinetic, electrostatic or any other means deemed suitable by the skilled artisan.

The particle may be controlled with respect to one of more parameters selected from motion and energy. With regard to motion, the control may be with regard to direction, velocity or spin. In the context of an electron multiplier, the apparatus is used to control the motion of an electron to an emissive surface and/or from an emissive surface to another emissive surface and/or from an emissive surface to an anode.

Control of electron energy may be required to extend the operable life of an electron multiplier. Deterioration in a multiplier may be caused by electron impact induced carbon deposition (this resulting in a decrease in electron yield from dynode surfaces). The rate of carbon deposition is proportional to the reaction cross-section, which increases with electron energy to provide for a lower electron energy which in turn extends to operable life. Smaller variation in the energy of electrons also tends to decrease carbon deposition rates.

Control of electron energy may provide advantage with regard to multiplier gain (or gain curve, being how fast gain changes with voltage). Secondary electron emission is a strong function of electron energy, controlling energy allows for tuning of a gain curve toward a desirable profile.

The present apparatus and methods have been described in the context of electron multiplier typically used in a mass spectrometer instrument. It is contemplated that the invention may have utility in settings other than mass spectrometers such as general charged particle detectors, in conjunction with a photo cathode as part of a photo multiplier tube, high energy particle detector, UV detector, electron detector. The charged particle transport function may have utility apart from the detection function in a wide variety of systems that involve manipulation of ions, electrons or charged particles.

While the present invention has been described mainly in terms of apparatus and methods for focusing secondary electrons caused by the impact of an ion on an emissive material, it is contemplated that utility will be found for other particles capable of causing an emissive surface to emit a secondary electron. Such particles include any charged particle, a neutral (uncharged) particle, an electron and a photon.

The present invention will now be more fully described by reference to the following non-limiting preferred embodiments.

PREFERRED EMBODIMENTS OF THE INVENTION

FIG. 1 shows a preferred apparatus 10 of the present invention. This apparatus forms part of an electron multiplier, and comprises a rare earth magnet 12 composed of $Nd_2Fe_{14}B$. The magnet 12 is rectangular prismatic, the drawing showing only the front surface 14, and the upper surface 16. The dimensions of the magnet 12 are ascertainable by reference to the scale bar of the drawing.

Two steel poles 18 are magnetically attached to the lateral surfaces (not shown) of the magnet 12. The dimensions of each pole 18 are identical being ascertainable by reference to the scale bar of the drawing.

Disposed above the magnet upper surface 16 is a grid 20, fabricated unitarily from mild steel. It will be noted that the grid 20 does not contact any part of the magnet 12 or poles 18. A supporting bracket (not shown) maintains the grid 20 in position above the upper magnet surface 16 and away from the inwardly facing walls of the poles 18.

The grid 20 is unitarily formed, being laser cut or etched from a single piece mild steel to have a series of parallel bars (two of which are marked as 22), the bars 22 are joined by joining regions (two of which are marked as 24).

The lower joining region marked 24 is elongate, while the upper joining region 24 has a more square geometry.

The grid 20 has a thickness of 1 mm, a length of 50 mm, and a width of 20 mm. The distance between the bars is 1 mm.

Figure 2A:
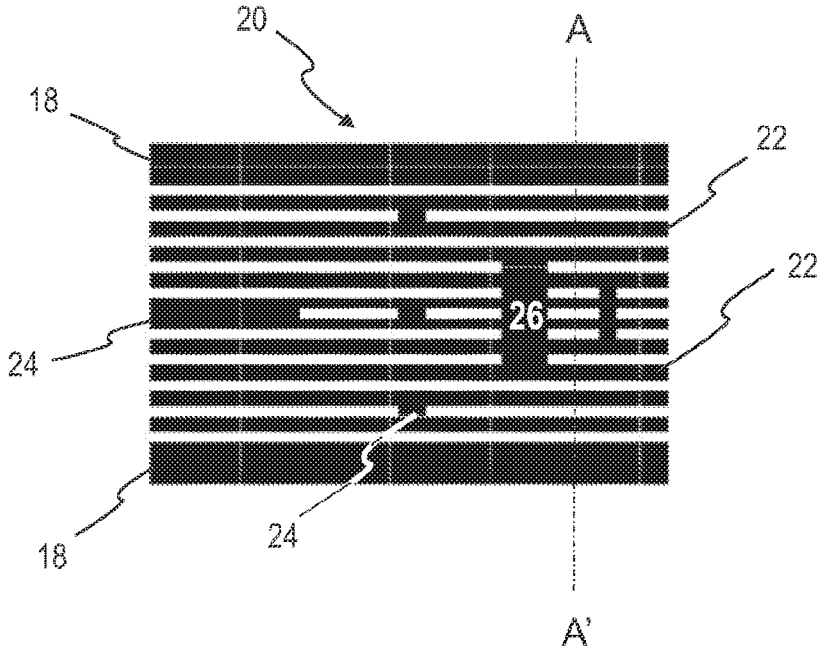
FIG. 2A is a plan view of the magnetically permeable grid shown in FIG. 1A FIG. 2B (client FIG. 4) is a diagram showing the magnetic field of the apparatus of FIG. 1. The diagram is in plan view, and taken through a section of the apparatus above the magnetically permeable grid. At that sectional level, the planar grid is not visible. The curved lines define lines of equal scalar magnetic flux density.

To more clearly illustrate the features of the grid 20, reference is made to the plan view of FIG. 2A.

In use, the electrons are accelerated into the channel defined by the upper surface of the grid 16, and the inner opposing faces of the poles 18, and controlled by the magnetic field within the channel. The magnetic field within the channel is shown in plan view in 2B. The plan view of the grid 20 above in FIG. 2A is broadly in register with the plan view of the field lines shown in FIG. 2B. In that regard, it will be noted from FIG. 2B that the magnetic field lines are distorted according to the positions of the bars and the joining regions. In particular, it will be seen that the joining regions cause local distortions and proportionally to the size. For example, the relatively large joining region marked 25 creates a relatively large distortion (generally indicated by the box marked 28), whereby the flux lines are highly compressed. In fact, the joining region 26 causes the flux lines originating from the poles to merge.

Figure 2B:
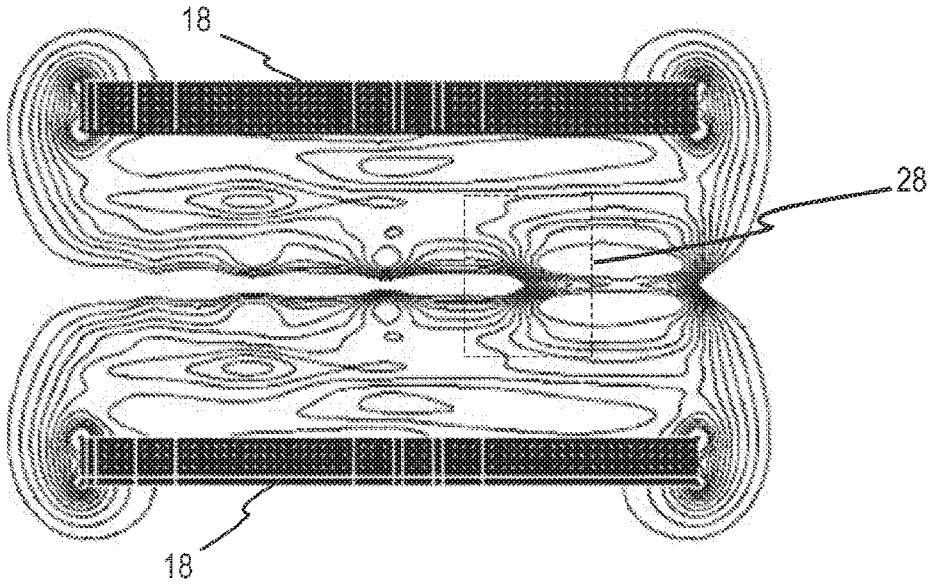
FIGS. 2C, 2D, 2E show magnetic flux maps in plan view for three cross sections of the area above the grid of FIG. 1.
FIGS. 2F, 2G and 2H show magnetic flux maps in plan view for three cross sections of the area above the magnet, but without the presence of a grid. These FIGS. are comparative with those of FIGS. 2C, 2D and 2E and highlight the effect of the grid on magnetic flux.
FIGS. 2I and 2J show a magnetic flux map from a front-on view for two cross-sections of the magnet of FIG. 1, but without the grid.
FIGS. 2K and 2L show a magnetic flux map from a front-on view for two cross-sections of the magnet of FIG. 1 (including the grid). These FIGS. are comparative with those of FIGS. 2I and 2J and highlight the effect of the grid on magnetic flux.
Figure 2C:
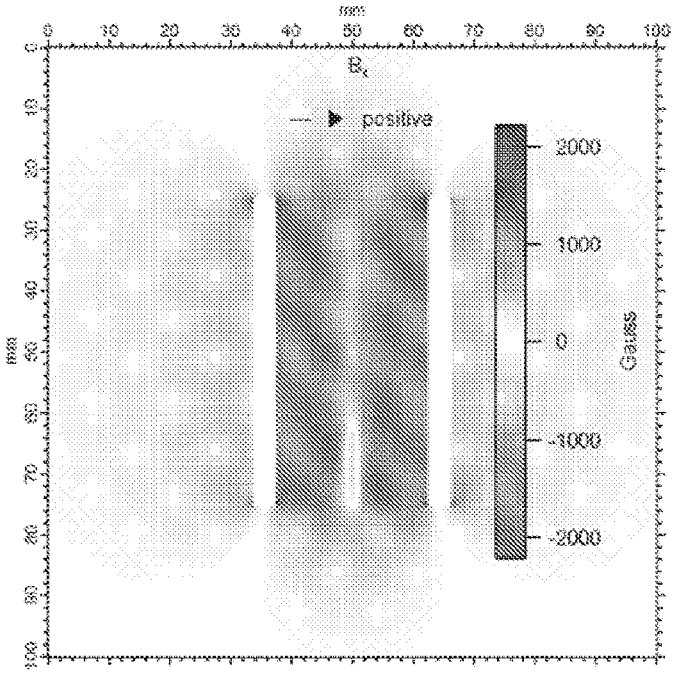
Figure 2D:
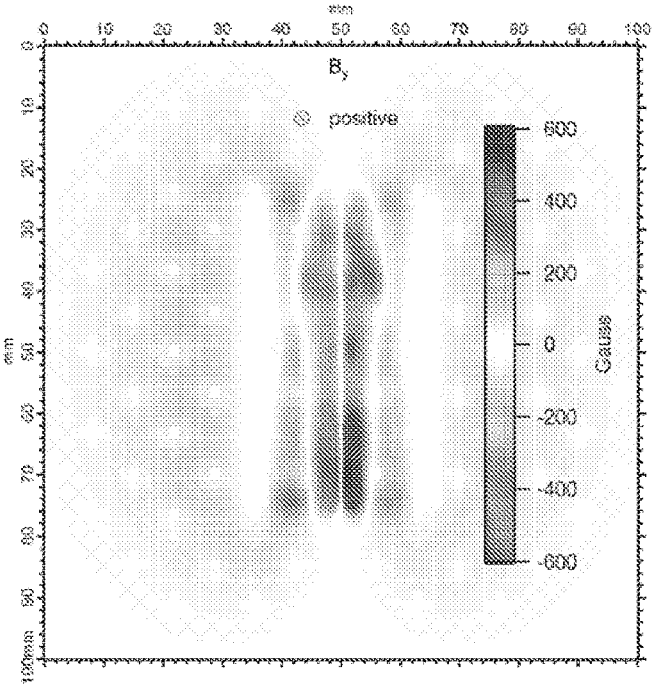
Figure 2E:
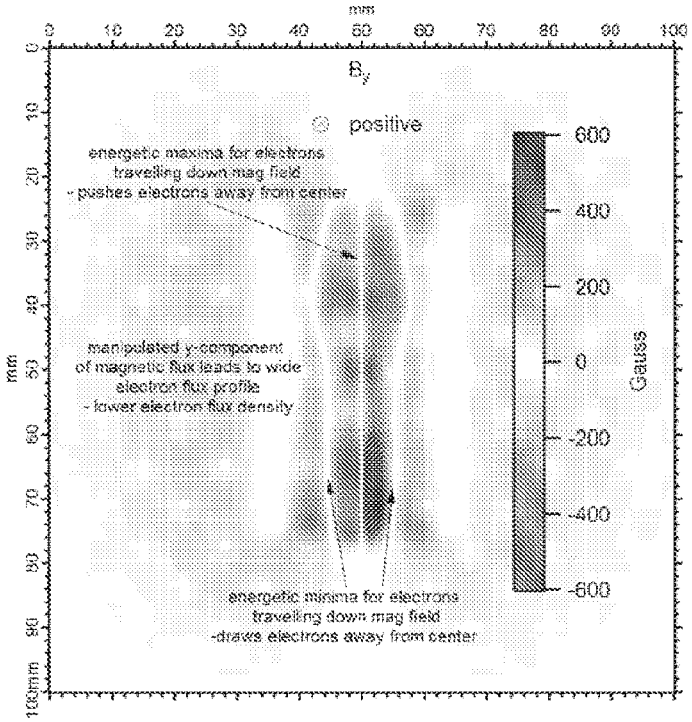
Figure 2F:
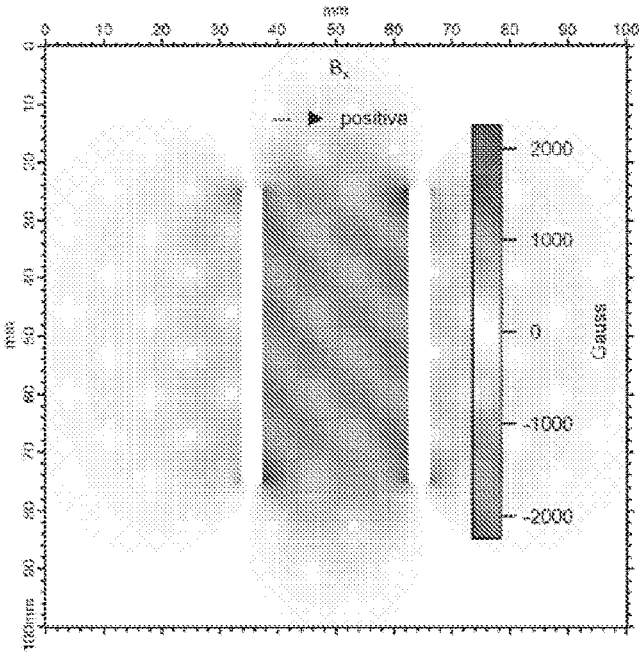
Figure 2G:
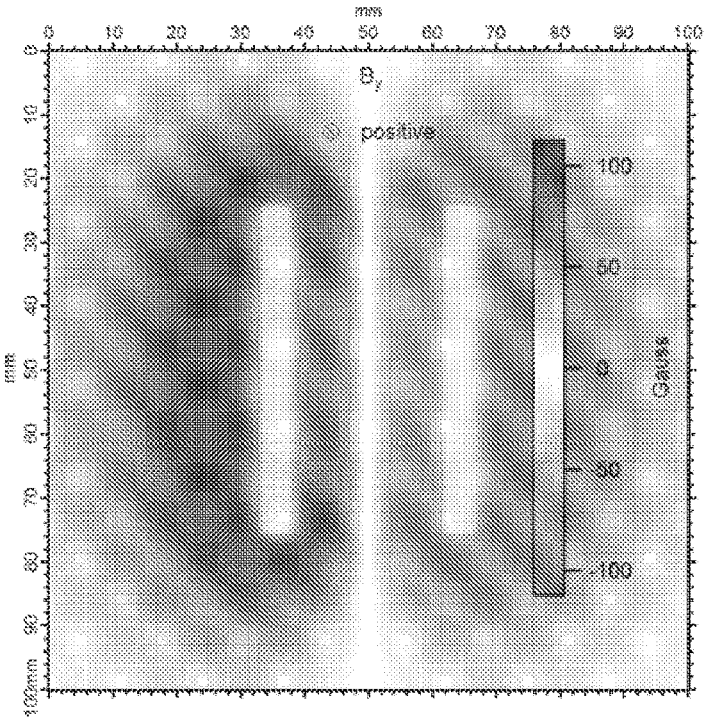
Figure 2H:
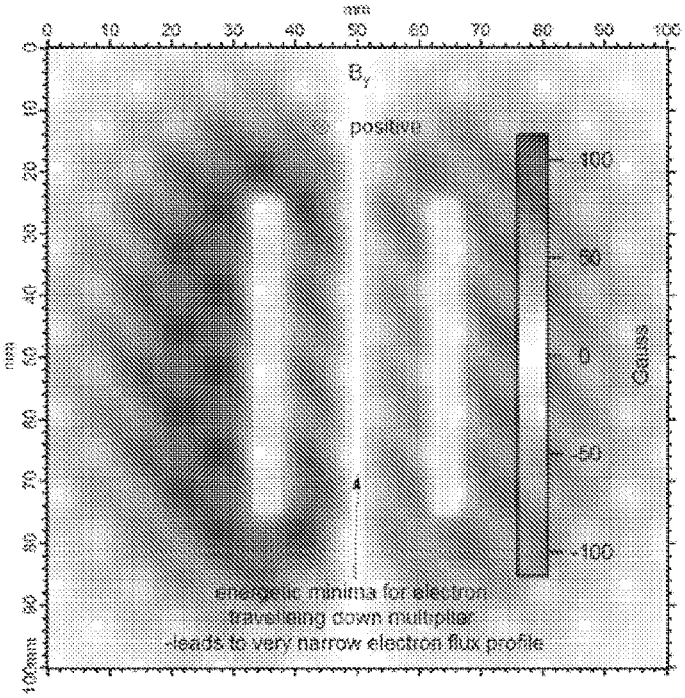
Figure 2I:
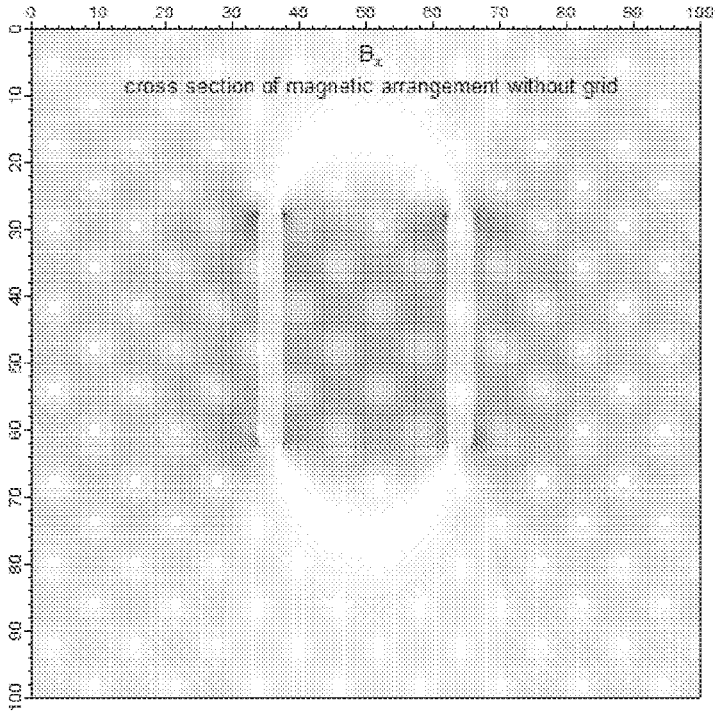
Figure 2J:
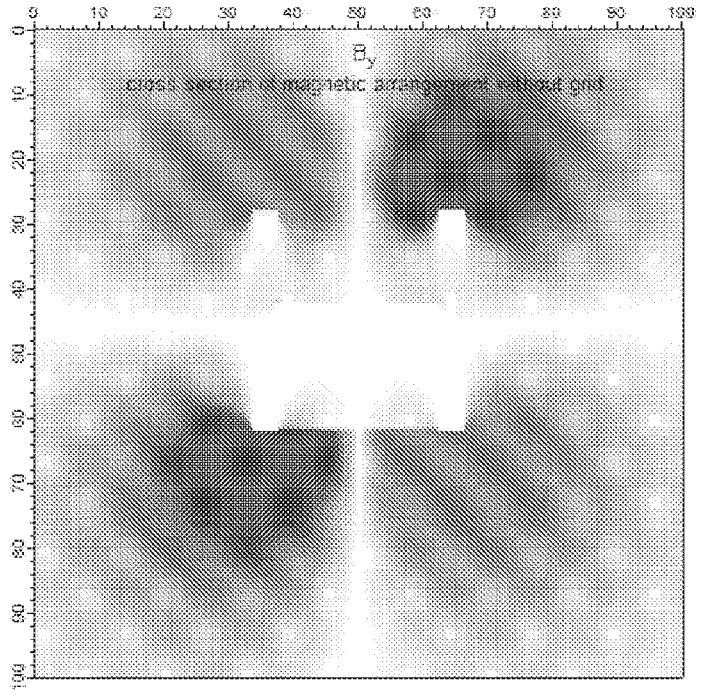
Figure 2K:
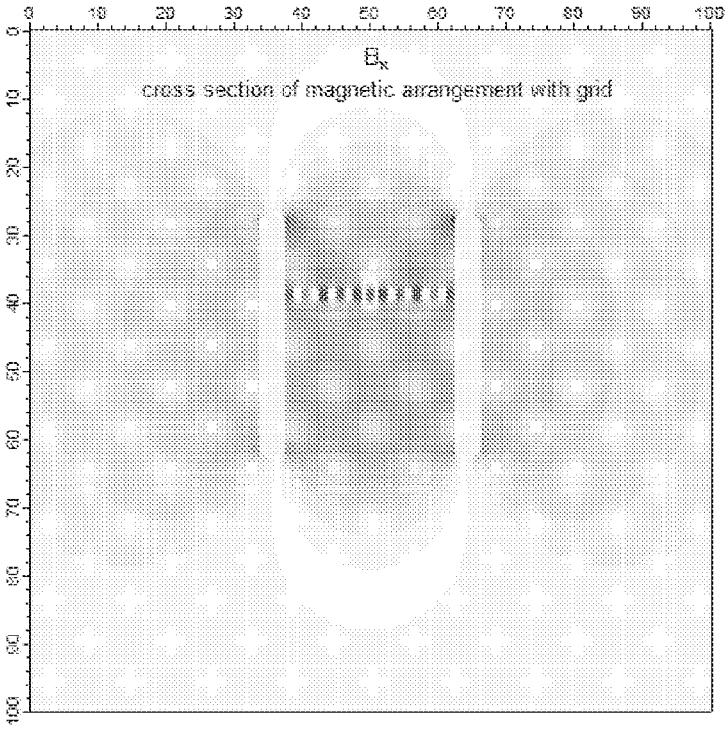
Figure 2L:
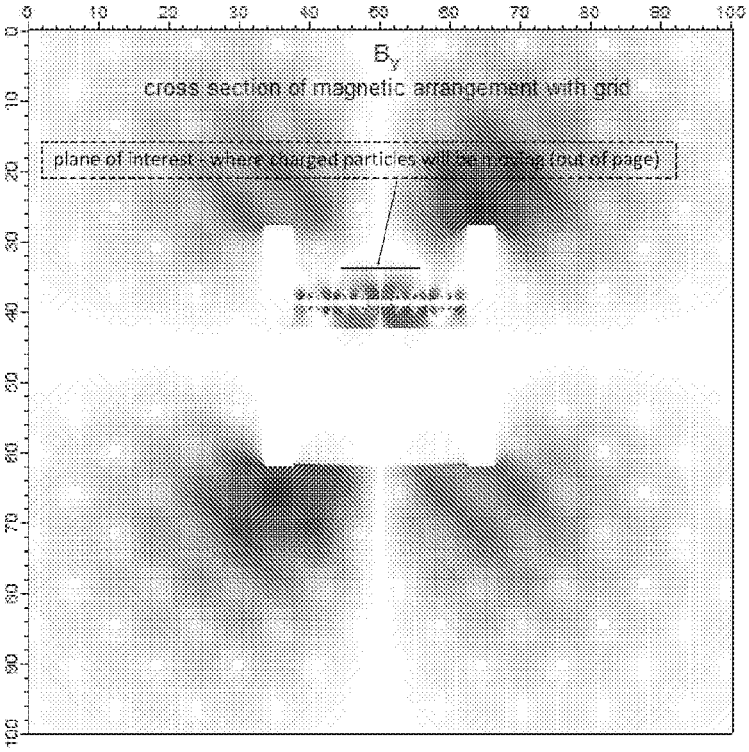

FIG. 2B shows lines of equal scalar flux demonstrating the field bunching around joins of the magnetically permeable material.

The colour maps of FIGS. 2C to 2L demonstrate how electron motion is affected by the fields around the grid structure, and comparative to the situation where no grid structure is present. Higher x-components cause the electrons to travel by shorter "hops" down the axis of the grid/magnet/arrangement.

Additionally positive or negative y-components (out of or into the page in FIG. 3, as drawn) will cause the electrons to deflect to the right or left side of the arrangement as they move down the axis, thereby spreading the electrons out and decreasing the electron flux density. In this example, the 'compression' in the scalar flux contour plot, what is changing most significantly is the y-component of the magnetic field (out of the page, as drawn). It is the change in strength of the y-component (i.e. out of the page, as drawn) that leads to the apparent bunching. The y-component of the field affects electrons travelling down the arrangement (axially) and pushes them away from the center of the grid. By application of Ampere's right-hand-screw rule it may be seen how electrons travelling down the page will experience force to the left or right depending on whether the field is pointing into or out of the page.

In the context of an electron multiplier, the distortions in the magnetic field serve to either spread the electrons as they travel down the multiplier or bunch them together. Spreading leads to lower electron flux densities, which leads to longer life of the multiplier.

Figure 3A:
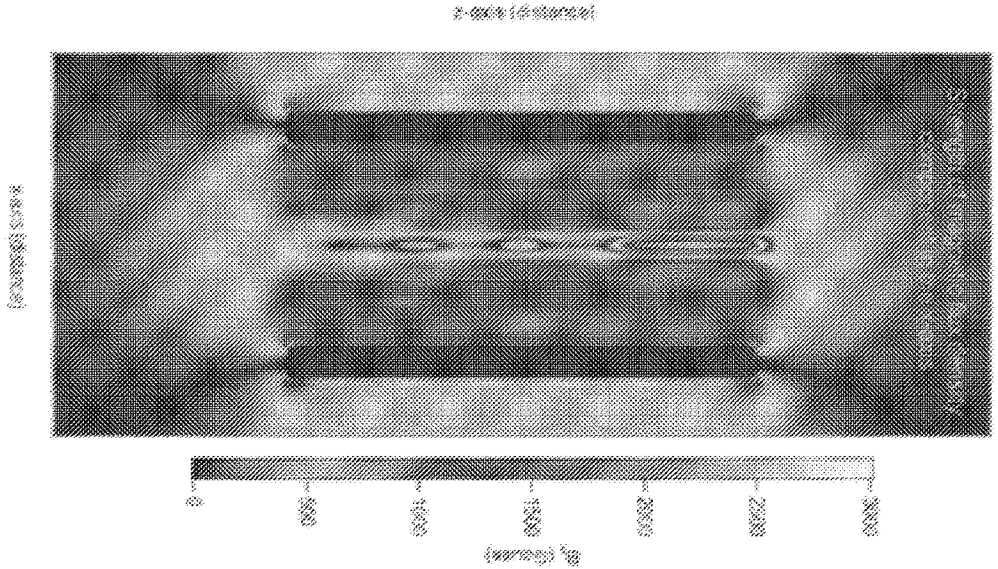
FIG. 3A is a magnetic map showing the strength of magnetic flux density component in the x-axis for the magnetically permeable grid of FIG. 1.
Figure 3B:
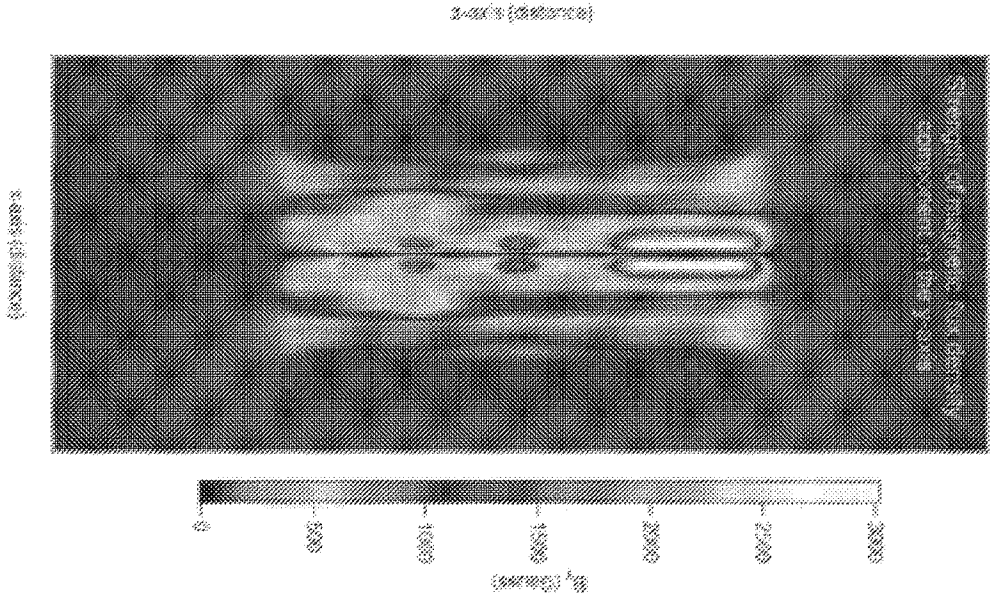
FIG. 3B is a magnetic map showing the strength of magnetic flux density component in the y-axis for the magnetically permeable grid of FIG. 1

More generally the distortions change the original field shape leading to different (and predictable) directional forces exerted on the electrons thus changing their path as they traverse the magnetic arrangement The larger distortions are also evident in the magnetic field maps shown in FIGS. 3A and 3B. The joining regions disposed along the central axis of the grid 20 (the largest of which is marked 26 in FIG. 2A). The distortion about the joining region 26 is most clearly shown by reference to the flux-density component in the y-axis which shows as the paired yellow areas in FIG. 3B.

Figure 4:
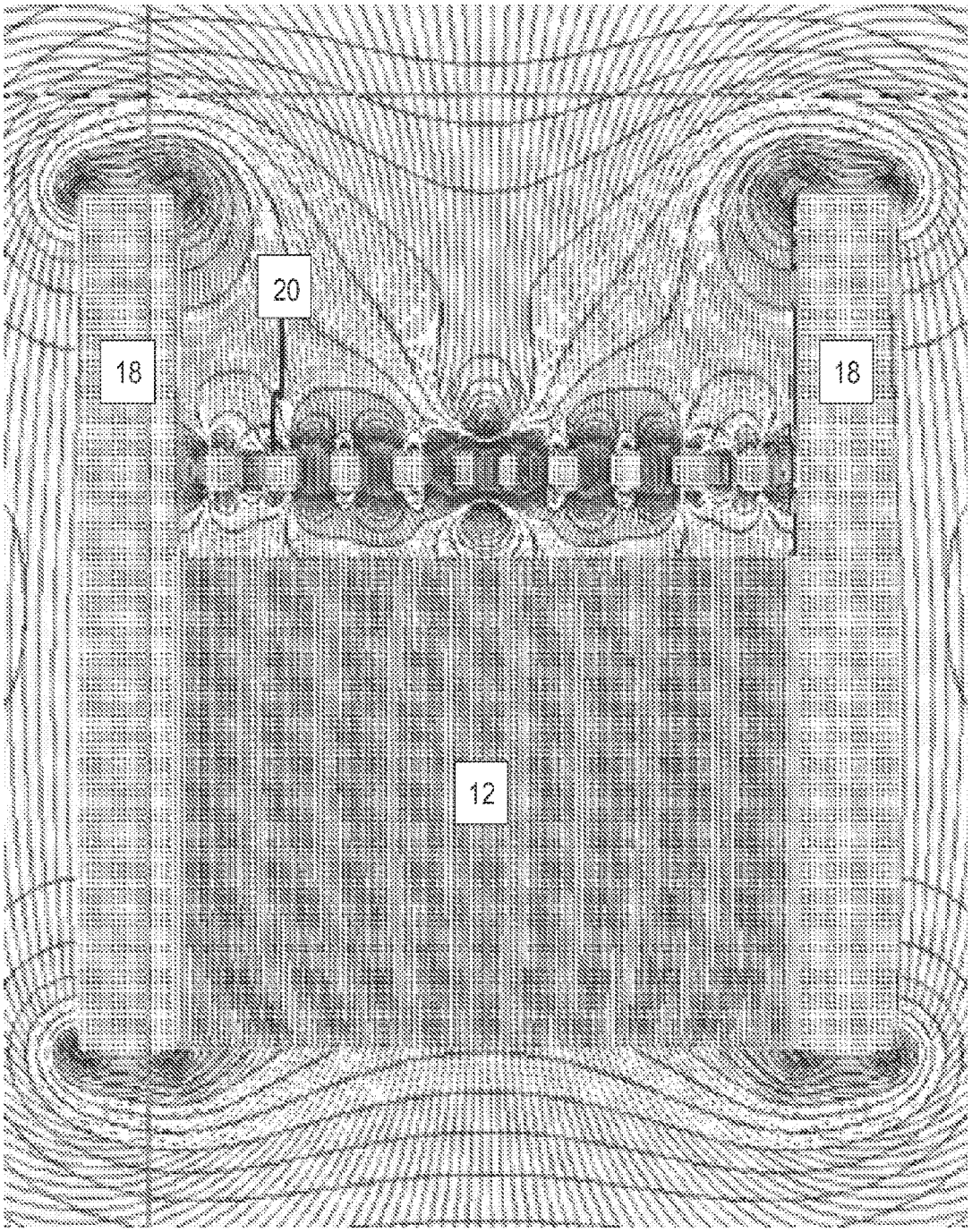
FIG. 4 is a diagram showing the magnetic field of the apparatus of FIG. 1. The diagram is a front view taken through the section marked A-A' on FIG. 2A. The blue lines connect points of equal scalar magnetic flux, and the red lines connect points of equal magnetic potential.
Figure 5:
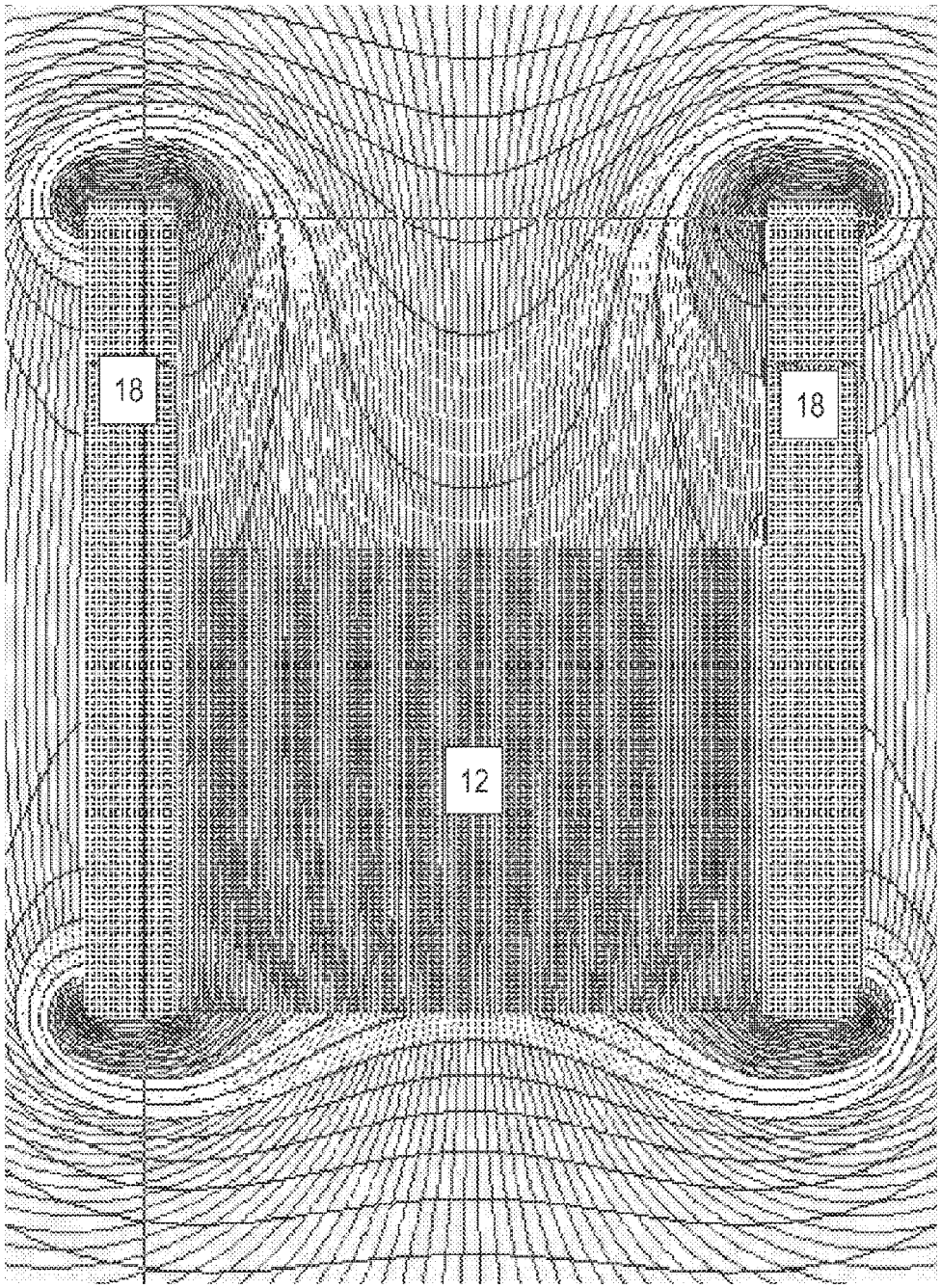
FIG. 5 is a diagram similar to that of FIG. 4, except that no magnetically permeable grid is included.

The end-on cross-sectional diagrams of FIG. 4 and FIG. 5 provides a further comparison between a magnetic field with the grid (FIG. 4), and without the grid (FIG. 5). It will be immediately noted that the regions about the bars of the grid 20 the field lines are highly distorted. The geometries of the distortions correlate with the regular spacing of the bars, with higher levels of distortion noted toward the central axis of the grid where most of the connecting regions are disposed. Distortions force electrons either to the left or right, and determine how short or long the hop down the axis will be.

Figure 6:
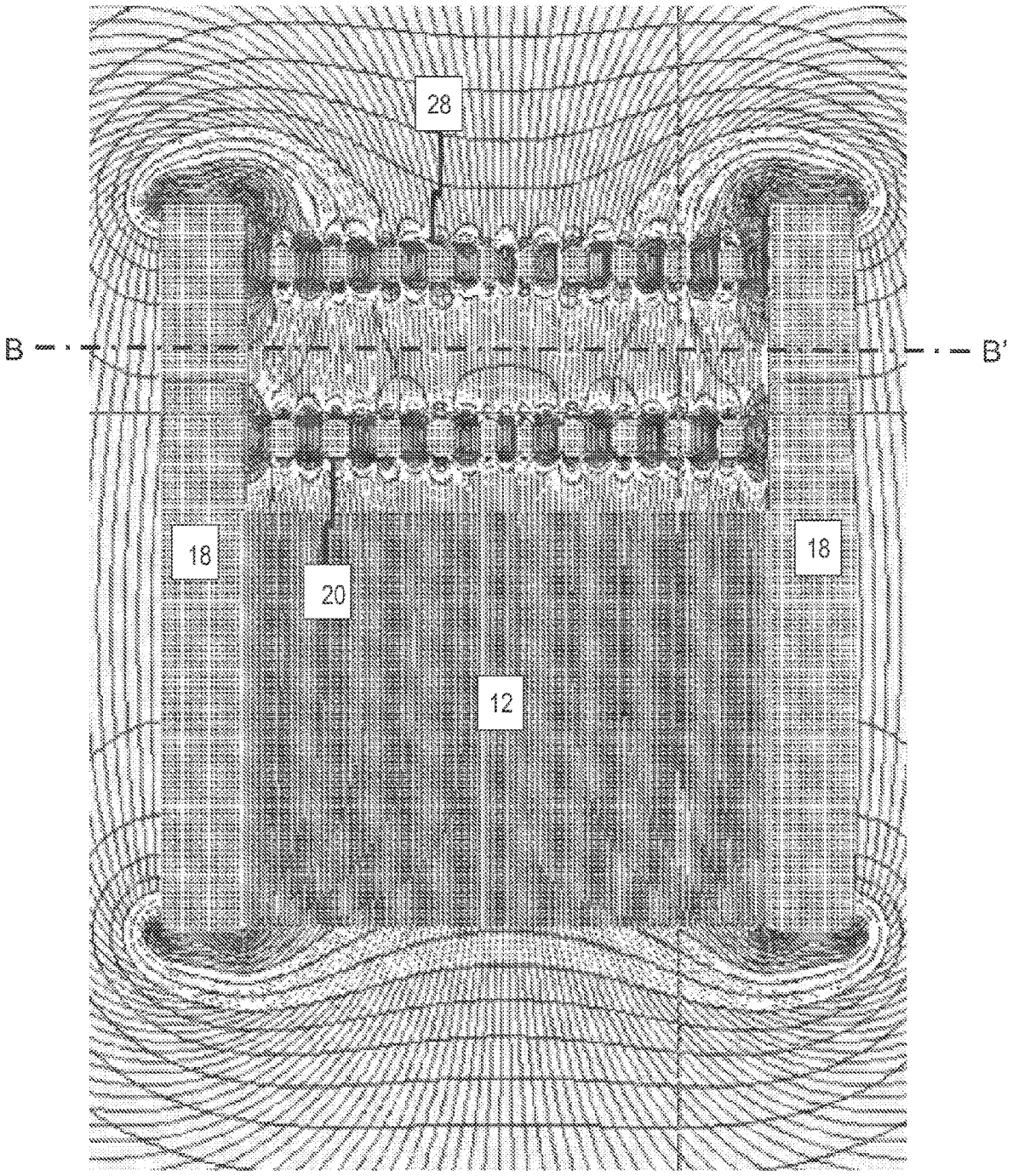
FIG. 6 is a diagram similar to that of FIG. 4, except that two magnetically permeable grids are used.
Figure 7A:
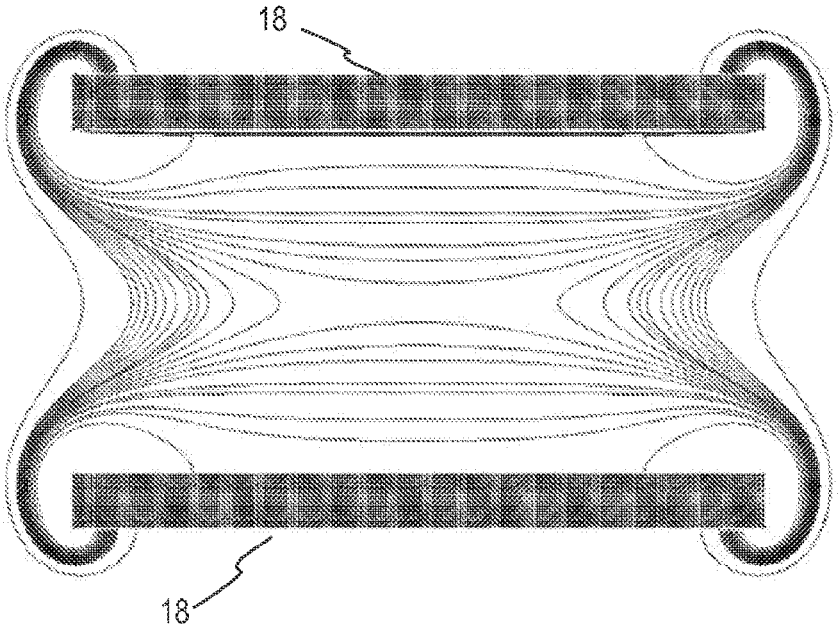
FIG. 7A is a diagram in plan view showing the magnetic field of the apparatus of FIG. 1, and taken through a section of the apparatus above the magnetically permeable grid. The curved lines define lines of equal scalar magnetic flux density.
Figure 7B:
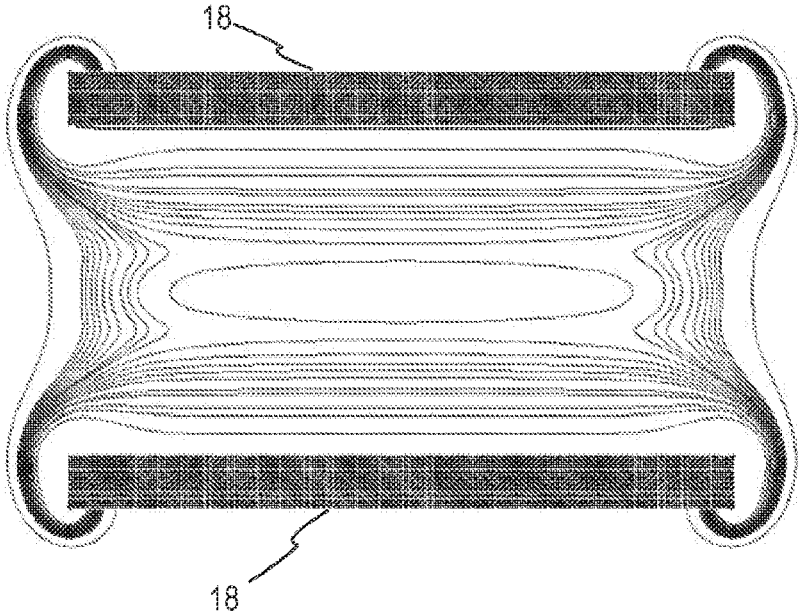
FIG. 7B is a diagram similar to that of FIG. 7A, except that two magnetically permeable grids are used, as per the embodiment of FIG. 6. The section of FIG. 7B is taken between the two grids, along the line B-B' of FIG. 6.

Turning now to FIG. 6, there is shown a similar apparatus to that of FIG. 4 except that a second grid 28 is disposed above the first grid 20. Both grids are identical and in register with each other. It has been found that the region between grids 20 and 28 provides for highly ordered grid lines, as shown in the plan view of FIG. 7A and FIG. 7B. FIG. 7A shows field lines in a cross-section above a single grid, whereas FIG. 7B is a cross-section between the two plates as shown by the line B-B' in FIG. 6.

These more ordered lines assist in electron control by allowing the placement of electrons with greater precision. If it is desired for the electron flux profile down the multiplier to be narrow, gaussian in shape, top-hat, have two parallel paths or switching between profiles (for example) it is possible to stack the grids (which need not be identical or in register) to shape the magnetic flux between the grids to achieve the required end.

Figure 8:
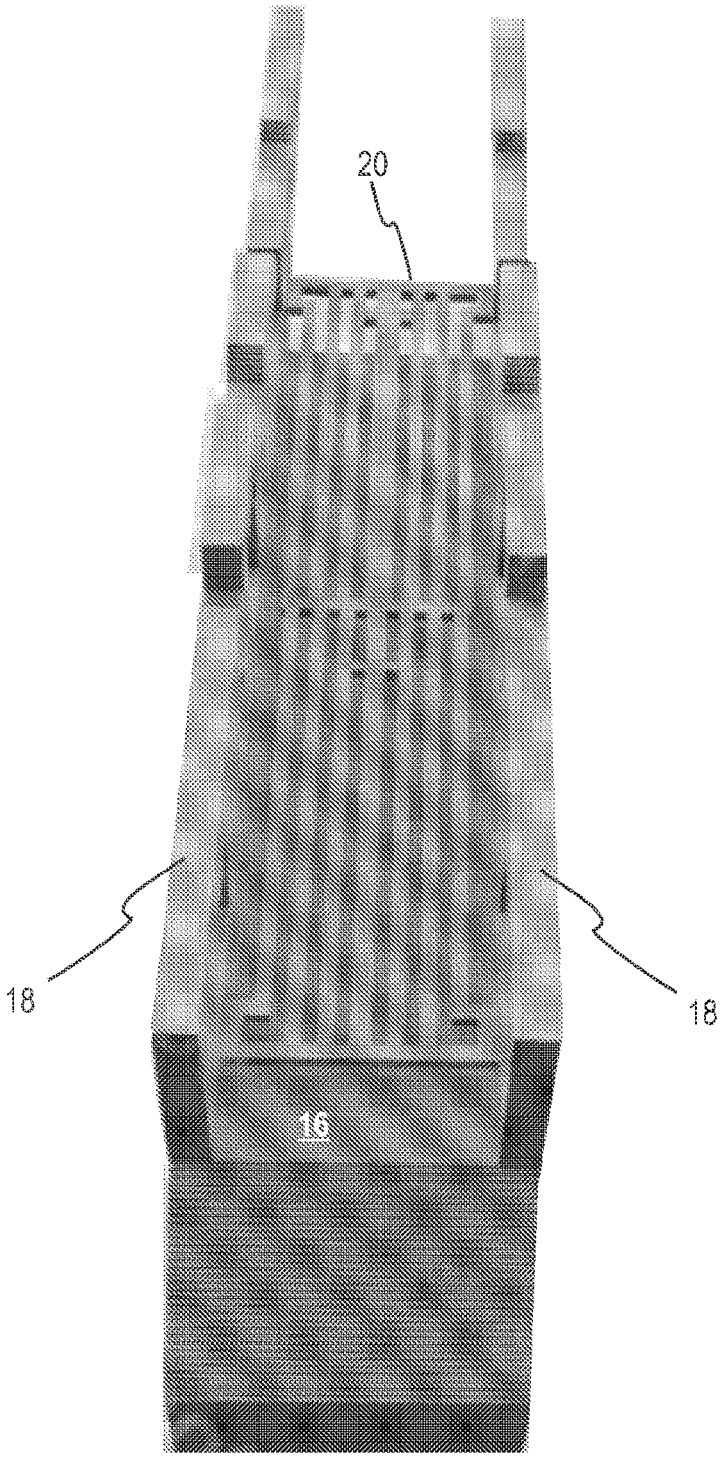
FIG. 8 is a perspective view of an alternative magnetically permeable grid of the present invention as disposed within a magnet of an electron multiplier.

An alternative form the apparatus is shown in FIG. 8 in which the components are numbered in accordance with those of FIG. 1. It will be noted that the grid 20 is of different conformation to that of FIG. 1. Different conformations may be used to provide electron flux profiles as described above.

It will be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. Functionality may be added or deleted from the diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

The invention claimed is:

1. An apparatus for providing a magnetic field, the apparatus comprising:

a magnet having a surface, a structure disposed above the magnet surface, the structure comprising one or more bars composed at least in part from a material of high magnetic permeability, and a material of low magnetic permeability, wherein each of the one or more bars and the material of low magnetic permeability are arranged into discrete regions, and the apparatus is configured so as to provide an interface between each of the one or more bars and the material of low magnetic permeability.

2. The apparatus of claim 1 comprising two poles in magnetic communication with the magnet, the poles extending above the surface of the magnet, and the structure is disposed between the poles.

3. The apparatus of claim 1 wherein the material of low magnetic permeability is a gas or vacuum surrounding the structure.

4. The apparatus of claim 1 wherein the one or more bars and the material low magnetic permeability are alternating.

5. The apparatus of claim 1 wherein the structure comprises two or more bars, and the bars are joined by one or more joining regions.

6. The apparatus of claim 5 wherein the joining regions are aligned generally across the lines of equal scalar magnetic flux density formed by the magnet.

7. The apparatus of claim 1 wherein the structure comprises two or more bars, and the bars are substantially parallel with each other, and/or substantially parallel with the magnet surface.

8. The apparatus of claim 1 wherein the one or more bars is/are aligned generally along the lines of equal scalar magnetic flux density formed by the magnet.

9. The apparatus of claim 1 comprising a second structure disposed above the first structure, the second structure is as described in claim 1.

10. The apparatus of claim 9 wherein the first structure is substantially parallel to the second structure.

11. The apparatus of claim 1 wherein the structure is disposed at least about 0.1 mm above the magnet surface.

12. The apparatus of claim 1 wherein the structure is disposed at least about 1 mm above the magnet surface.

13. The apparatus of claim 1 wherein the magnet surface is substantially planar, and the structure is substantially parallel to the magnet surface.

14. The apparatus of claim 1 wherein the structure is configured to alter the magnetic field of the magnet to reduce or remove a disorder in the magnetic field, and/or decrease the magnitude of the magnetic field, and/or induce a distortion in the magnetic field, and/or align or re-align the magnetic field, and/or orientate or re-orientate the magnetic field, and/or alter the distribution or shape of the magnetic field.

15. An electron multiplier comprising the apparatus of claim 1.

16. The method of claim 1, further comprising:

amplifying an electron signal by performing the act of controlling the magnetic particle, wherein control of the electron is used to urge an electron toward and/or away from a dynode.

17. A method comprising:

controlling a magnetic particle, comprising acts of:

providing a magnetic particle, providing an apparatus for providing a magnetic field, the apparatus comprising:

a magnet having a surface, a structure disposed above the magnet surface, the structure comprising one or more bars composed at least in part from a material of high magnetic permeability, and a material of low magnetic permeability, wherein each of the one or more bars and the material of low magnetic permeability are arranged into discrete regions, and the apparatus is configured so as to provide an interface between each of the one or more bars and the material of low magnetic permeability, urging the magnetic particle toward the apparatus, and allowing the apparatus to control the magnetic particle.

18. The method of claim 17 wherein the magnetic particle is an electron.

* * * * *